United States Patent [19]

Wilhite et al.

[11] Patent Number: 4,678,744

[45] Date of Patent: Jul. 7, 1987

[54] SPLASH-PREPARED SILVER HALIDE EMULSIONS WITH A UNIFORM PARTICLE SIZE DISTRIBUTION

[75] Inventors: Douglas L. Wilhite; Daniel J. Mickewich, both of Wilmington, Del.

[73] Assignee: E. I. Du Pont de Nemours and Company, Wilmington, Del.

[21] Appl. No.: 821,171

[22] Filed: Jan. 13, 1986

Related U.S. Application Data

[63] Continuation-in-part of Ser. No. 647,808, Sep. 6, 1984, abandoned.

[51] Int. Cl.[4] ..... G03C 1/02

[52] U.S. Cl. ..... 430/569; 430/567

[58] Field of Search ..... 430/569, 567

[56] References Cited

U.S. PATENT DOCUMENTS 4,334,012 6/1982 Mignot ..... 430/567
4,339,532 7/1982 Corben et al. ..... 430/567
4,349,622 9/1982 Koitabashi et al. ..... 430/567
4,414,310 11/1983 Daubendiek et al. ..... 430/567

FOREIGN PATENT DOCUMENTS 1162689 2/1964 Fed. Rep. of Germany .
1170648 11/1969 United Kingdom .
1350619 1/1974 United Kingdom .

OTHER PUBLICATIONS

Research Disclosure No. 18155, pp. 265–268, 5/1979, Evans et al.

*Primary Examiner*—John E. Kittle
*Assistant Examiner*—Mukund J. Shah

[57] ABSTRACT

Silver halide emulsions with a narrow and uniform particle size distribution are made by introducing monodisperse seed crystals into a gelatin-salts mixture, followed by splash-preparation procedures to make the final emulsion.

8 Claims, No Drawings

SPLASH-PREPARED SILVER HALIDE EMULSIONS WITH A UNIFORM PARTICLE SIZE DISTRIBUTION

CROSS-REFERENCE TO RELATED APPLICATION

This application is a continuation-in-part of Ser. No. 647,808 filed Sept. 6, 1984, now abandoned.

BACKGROUND OF THE INVENTION

1. Field of the Invention

This invention relates to the field of silver halide emulsion manufacture and particularly to silver halides made by the so-called "splash-precipitation" method. Still more particularly, this invention relates to a method for making splash-prepared silver halide emulsions with a uniform particle size distribution of the silver halide crystals.

2. State of the Art

Preparation of sensitive silver halides for a photographic emulsion is a complex process. Basically the silver halide crystals can be prepared by three well-known methods: the single jet method; the "splash" method; or the double jet or balanced double jet (BDJ) method. In the single jet method, all of the halide solution is placed in the mixing vessel together with the protective colloid (e.g., gelatin) right from the start and the silver nitrate solution is then added to this mixture over a relatively long period of time, e.g., 20 to 25 minutes. This procedure is exemplified by Corben et al. U.S. Pat. No. 4,339,532, Example 14. In the so-called "splash" method for making silver halide crystals, the silver nitrate solution is added in a series (e.g., 2–4) of finite "splashes" to the vessel containing the halide and protective colloid. Conventionally, some ammonia is present in one or more of these silver solutions. In the BDJ method, the halide solution and the silver nitrate solution are added simultaneously to a solution of gelatin in the mixing vessel. Conventionally a small amount of halide solution may be present in the mixing vessel prior to the start of BDJ addition.

The splash precipitation process usually creates an increased number of so-called "crystal lattice defects" in which a number of ions are not positioned correctly in the silver ion-halide ion network. Emulsions made from these crystals can be used to make films which exhibit improved sensitometry, especially improved speed, as compared with films made from silver halide emulsions with crystals that have few or no lattice defects or disorientation. In spite of this advantage, it is difficult to make splash-prepared emulsions with a uniform distribution of particle sizes. In many areas of photography it is important that emulsions have this uniform distribution in order to control gradient. For example, in the field of medical x-ray, the emulsions used to prepare these films are conventionally prepared by splash or single jet procedures. These procedures produce a large number of crystal defects but because of the nonuniformity of the particle size distribution also have lower gradient. On the other hand, production of silver halide crystals by the BDJ process will yield crystals having good uniformity of particle size but these crystals generally lack the disorientation or lattice defects and thus will not be as inherently fast as splash-prepared emulsions.

It is also known to use a seed emulsion with a known particle size, said seed emulsion or crystal being added during the preparation of BDJ or single jet emulsions. In a BDJ procedure silver halide forms on these seeds and produces a uniform final crystal. This process has not been used for the splash preparation of crystals since it was thought that crystals with a narrow particle size distribution and a high internal defect density could not be produced thereby.

SUMMARY OF THE INVENTION

In accordance with this invention there is provided in a process for preparing silver halide emulsions with a narrow particle size distribution and highly disordered crystals, wherein silver nitrate solution is added to a solution of halide salt dispersed in a protective colloid in a series of rapid additions, at least one of said additions containing ammonia, the improvement comprising adding monodisperse silver halide seed crystals prepared by a BDJ process to said halide salt solution prior to the addition of said silver nitrate solution.

The addition of monodisperse seed crystals, themselves made by the BDJ process, to a gelatin halide salt solution prior to the addition of the silver nitrate by the splash process, achieves the best of both processes. The resulting distribution of crystal sizes is more monodisperse than usually obtained by the splash process, but the crystals are still highly disordered. The crystal size and distribution are uniform and predictable, controlled by the size, number, and distribution of the seed crystals in the gelatin/halide salt solution, and by the total amount of silver added during the splash process. Thus it is possible to vary the particle size distribution predictably in a splash-prepared emulsion by simply preparing the seed crystals by a BDJ process, which process itself produces a narrow range of particle sizes. A combination of the two precipitation procedures is made possible following the teachings of this invention.

DETAILED DESCRIPTION OF THE INVENTION

The process of this invention is applicable to the manufacture of any of the conventionally prepared silver halides such as silver bromide, chloride, iodide, or mixtures thereof, preferably silver iodobromide. Any of the conventional protective colloids such as gelatin may also be used, as well as water-permeable or water-soluble polyvinyl alcohol and its derivatives, partially hydrolysed polyvinyl acetates, polyvinyl ethers, etc. Other useful protective colloids include partially hydrolysed gelatin, poly-N-vinyl lactam, etc. Gelatin is preferred since it is well known that it is the protective colloid of choice during precipitation of the silver halides and the formation of the crystals thereof.

Conventionally, the desired halide salts are added to an aqueous dispersion of a protective colloid, e.g., gelatin. One then adds the desired amount of silver halide seed crystals of the desired size already prepared by a BDJ process, and commences stirring, which continues through the duration of the process. At a desired time and temperature, aqueous silver nitrate is added by the splash method. This is accomplished with at least two rapid additions, e.g., 2 to 6 rapid additions, preferably 2 to 4 rapid additions, and more preferably 2 to 3 rapid additions. The duration of each rapid addition of silver nitrate solution ranges from 0.25 to 2 minutes, preferably each rapid addition being in the range of 20 to 40 seconds. After each rapid addition of silver nitrate solution, one or more of which contains ammonia, e.g., 0.5 to 4 moles of ammonia per mole of silver nitrate, the reaction mixture is maintained for a period of 2 to 15 minutes, preferably 3 to 7 minutes. In another embodiment some of the halide salt can be added to the gelatin in the reaction vessel and the remainder added after some of the silver nitrate has been added.

The seed crystals, as previously stated, are made by the BDJ process following those well-known procedures. By varying those procedures it is possible to make crystals of any average particle size distribution and select one to be used as desired in the ambit of this invention. The seed crystals can be also made of any of the conventional halides such as silver bromide, silver chloride, silver iodobromide, silver bromo-chloride and silver iodide, for example, Additionally, these seed crystals may be doped with other metals such as rhodium and lead, for example, as is well known.

After the final silver nitrate addition the emulsion is stirred for 2 to 15 minutes, preferably 3 to 7 minutes. At this point the emulsion is coagulated and washed followed by redispersion with colloid binder. Chemical and spectral sensitization can then be accomplished as is well known. Following the sensitization step, hardeners, wetting agents, antifoggants, stabilizers, coating aids, etc., may be added. The emulsion can then be coated on any of the well-known photographic substrates such as, for example, polyethylene terephthalate film, suitably subbed (subcoated) to receive the silver halide emulsion coating. The coated emulsion may be overcoated with a protective antiabrasion layer, such as hardened gelatin. These films may be used in any of the conventional ways, for example, as X-ray or graphic-arts films or as direct positives depending on the way the emulsion is made, and sensitized and the product structure is manufactured.

This invention will now be illustrated by the following specific examples of which Example 6 is considered to represent a preferred mode.

EXAMPLE 1

Four samples of silver halide seed crystals were prepared following standard, BDJ procedures. The halide composition and the average particle size as determined by a Silver Halide Electrolytic Particle Size Analyzer, (Ref. A. B. Holland and J. R. Sawers, *Photogr. Sci. Eng.* 17, 295 (1973) was as follows:

| Sample | Halide | Particle Size ($\mu^3$) |
|---|---|---|
| 1 | Bromide | 0.02 |
| 2 | Bromide | 0.06 |
| 3 | Iodobromide (1% I) | 0.03 |
| 4 | Iodobromide (1% I) | 0.06 |

These seed crystals of silver bromide and Ag(I)Br, each containing a small amount of bone gelatin from the precipitation process, were redispersed by stirring in gelatin and water for about 3 hours and the pH adjusted to about 6.3–6.7. These seeds were then used at approximately 0.09 moles per 0.51 moles of added silver nitrate (18%) to seed emulsions made by the splash technique using the following solutions and procedure:

| | | |
|---|---|---|
| | | A. Solution: |
| 7 | g | gelatin |
| 120 | cc | deionized water |

-continued

| | | |
|---|---|---|
| 52 | g | $NH_4Br$ |
| 20 | cc | 0.5 M KI |
| 0.09 | mole | Seeds from above |
| | | B. Solution: |
| 140 | cc | deionized water |
| 45 | cc | 3.0 M $AgNO_3$ |
| 30 | cc | 12.0 M $NH_4OH$ |
| | | C. Solution: |
| 70 | cc | deionized water |
| 125 | cc | 3.0 M $AgNO_3$ |
| | | D. Solution: |
| 23 | cc | glacial acetic acid |
| | | E. Solution: |
| 10 | cc | coagulant (a poly-anion, see U.S. Pat. No. 2,772,165) |
| | | G. Solution: |
| 120 | cc | 3 M $H_2SO_4$ |

Solution A was placed in a mixing vessel and heated to 105° F. with stirring. Solution B was then added to A over a 30 second period (first "splash" of silver nitrate). This mixture was ripened 5 min. at 105° F. and then solution C added thereto over a 30 second period (second "splash" of silver nitrate). After ripening this mixture for 8 minutes, solution D was added to stop the ripening process. The coagulant was then added to coagulate the gelatino-silver halide as "curds" and these curds were then washed to remove excess soluble salts by adding deionized water and decanting to remove the water and salts. The G solution was available to adjust the pH to 3.0. For control purposes, a splash precipitation process identical to this one, but without any seeds present, was also run (Sample 5). Samples of the emulsion were then analyzed using the Particle Size Analyzer. Additionally, electron micrographs were taken of each emulsion. These results indicate that the final emulsion in each case had crystals of approximately the same volume as the control and, more importantly, that these emulsions were more uniform than the control. The control emulsion was not uniform and had a wider distribution of crystal sizes.

| Sample | Volume ($\mu^3$) | $\sigma_g$* |
|---|---|---|
| 1 | 0.291 | 1.86 |
| 2 | 0.456 | 1.50 |
| 3 | 0.258 | 1.56 |
| 4 | 0.505 | 1.37 |
| 5 | 0.373 | 2.11 |

*a polydispersity index-the smaller $\sigma_g$, the more uniform the range of particle sizes.

EXAMPLE 2

Four additional splash-prepared silver iodobromide emulsions were made. In three of these emulsions, seeds of $0.068\mu^3$, $\sigma_g=1.34$, silver iodobromide (2% iodide) were used in varying proportions. The procedures followed were identical to Example 1 except for the amount of the first silver splash (30% vs ca. 27% in Example 1) and the amount of seeds used which was as follows:

| Sample | Amt. of Seed (moles/mole of $AgNO_3$) | Volume ($\mu^3$) | $\sigma_g$ |
|---|---|---|---|
| 1 | 0.05 | 0.38 | 1.88 |
| 2 | 0.1 | 0.51 | 1.72 |
| 3 | 0.2 | 0.45 | 1.36 |

-continued

| Sample | Amt. of Seed (moles/mole of $AgNO_3$) | Volume ($\mu^3$) | $\sigma_g$ |
|---|---|---|---|
| 4 | none - control | 0.48 | 1.85 |

After the completion of the emulsion making process by splash techniques, the particle sizes were examined and electron micrographs taken. Samples 2 and 3, the samples of this invention, exhibited improved uniformity and particle sizes close to that of the control emulsion. This example demonstrates that up to 0.2 moles of seeds/mole of $AgNO_3$ can be tolerated.

EXAMPLE 3

To demonstrate the photographic utility of emulsions prepared according to the teachings of this invention, four more splash-prepared emulsions were prepared as described in Example 1. The seeds used in three of these emulsions were identical to those of Example 2. The addition of the silver nitrate solution to the emulsions was varied as described below:

| Sample | Type of Mix |
|---|---|
| 1 | Two-quick splashes, 30 seconds (same as EX. 1) |
| 2 | 2 long splashes (4.8 and 4.9 minutes) |
| 3 | 1 long splash (7.5 minutes) |
| 4 - Control - No seeds | Two-quick splashes (same as EX. 1) |

These emulsions were then brought to their optimum sensitivity with gold and sulfur sensitization as is well known to those skilled in the art. After the addition of the usual wetting agents, antifoggants, hardeners, etc. each emulsion was then coated on polyethylene terephthalate film supports suitably coated with a subbing layer and a thin anchoring substratum of gelatin. Each sample was overcoated with a hardened gelatin anti-abrasion layer. Coating weights were about 47 mg $AgBr/dm^2$. Sample strips from each coating were sandwiched between two Cronex® HiPlus screens and exposed to an X-ray source operated at 60 Kvp, 100 ma at 40 inches for 40 milliseconds through a square root of two aluminum step wedge. They were then processed in a standard hydroquinone/phenidone mixed developer, followed by fixing and washing in a conventional manner. Sensitometry obtained was as follows:

| Sample | Fog | Speed | Toe Gradient | Top Density | V ($\mu^3$) | $\sigma_g$ |
|---|---|---|---|---|---|---|
| 1 | 0.16 | 41 | 2.44 | 1.84 | 0.44 | 1.27 |
| 2 | 0.15 | 36 | 2.37 | 2.07 | 0.43 | 1.28 |
| 3 | 0.15 | 32 | 2.17 | 1.98 | 0.36 | 1.49 |
| 4 Control | 0.26 | 100 | 1.98 | 2.22 | 0.40 | 2.04 |

Electron micrographs indicate that the control emulsion had standard splash-prepared crystals with a variety of crystal sizes while those of the invention were more uniform and had particle sizes close to that of the control crystals. One can see that the emulsions of this invention produced better gradients in the toe region then the control.

EXAMPLE 4

Four splash-prepared emulsions were made for this example as taught in Example 1. The three emulsions representing this invention used seed crystals identical to those of Example 2 added at 0.2 mole/mole of added $AgNO_3$. Variations in the making procedures were as follows:

Silver halide composition AgIBr (4% iodide).

Added ammonia to A solution alone.

Iodide addition—½ to A solution, ½ added after 1st silver nitrate splash.

The % silver in the first splash was varied as shown below. A Control (no seeds) was also employed. The emulsions were redispersed, sensitized, coated, overcoated, dried, exposed and processed as described in Example 3. The following results were obtained:

| Sample | % Ag in 1st Splash | Fog | Speed | Gradient | Top Density | V ($\mu^3$) | $\sigma_g$ |
|---|---|---|---|---|---|---|---|
| 1 | 25 | 0.18 | 52 | 2.52 | 1.80 | .42 | 1.24 |
| 2 | 45 | 0.16 | 47 | 2.43 | 1.68 | .43 | 1.29 |
| 3 | 65 | 0.16 | 47 | 2.59 | 1.80 | .39 | 1.27 |
| 4 Control | — | 0.18 | 100 | 2.16 | 2.13 | .50 | 1.86 |

Other experiments were also conducted with variants in procedures such as lowered ripening times and lowered ripening temperatures. In all cases, the emulsions made according to this invention had high gradients but somewhat lower speeds. And, in all cases, the electron micrographs showed that the crystals from the emulsions representing this invention had particle sizes close to that of the control crystals and that the particle sizes were more uniform than the controls. These experiments, then, demonstrate the wide utility of the procedures of this invention.

EXAMPLE 5

To further demonstrate the utility of the process of this invention, two splash-prepared emulsions were made in the manner described in Example 1 except that seeds were added to one and the other (Control) prepared without seeds. The type of seeds and amount was as described in Example 2. During the precipitation process samples were withdrawn at regular intervals for analysis of particle size and examination by electron microscopy. These results indicate that the emulsion of this invention (seeded) ripened faster than the control and the crystals reached their optimum size and size distribution sooner.

| | Time* (minutes) | | | | | | |
|---|---|---|---|---|---|---|---|
| | 1 | 3 | 5 | 7 | 9 | 11 | 13 |
| Seeded | | | | | | | |
| V($\mu^3$) | 0.14 | 0.17 | 0.19 | 0.40 | 0.45 | 0.46 | 0.47 |
| $\sigma_g$ | 2.18 | 1.37 | 1.31 | 1.51 | 1.39 | 1.38 | 1.38 |
| Control | | | | | | | |
| V($\mu^3$) | 0.014 | 0.15 | 0.14 | 0.21 | 0.33 | 0.39 | 0.41 |
| $\sigma_g$ | 3.84 | 2.57 | 2.44 | 5.78 | 2.96 | 2.00 | 2.22 |

*(minutes after beginning addition of 1st Ag solution) the second silver solution is added at 5 minutes

EXAMPLE 6

In a like manner two more splash-prepared emulsions were made following procedures previously described. In this case, the procedures were as described in Example 4, Sample 1 except that ½$I^-$ added to "A", ½$I^-$ added to mix vessel over 7 minutes beginning with the 1st silver splash. One emulsion had seeds; the other was the control. After ripening and redispersing the emulsion, the emulsions were sensitized. During these procedures, varying samples of the emulsions were sensitized at varying levels of sulfur sensitizer and varying digestion times. Sensitometric results indicate that the emulsions prepared according to the teachings of this invention have wider sensitization latitude than the control. Results were as follows:

| Crystal parameters | Vol. ($\mu^3$) | $\sigma_g$ |
|---|---|---|
| Control | .32 | 2.16 |
| Experimental | .30 | 1.56 |

Sensitization conditions:

1.3 mg $AuCl_3$/mole Ag; 0.1 g NaSCN/mole Ag for both;
for control, 1.7 mg/mole Ag
for experimental, 2.7 mg/mole Ag
} of $Na_2S_2O_3.5H_2O$ typical stabilizers were added, samples coated Exposure, development conditions:
Kodak Model 101 process and control sensitometer, 1/5 sec. exposure through square root of two stepwedge; developed in HSD at 84° F. for 90 seconds.

| Results: Digestion Time (min.) | Fog | Rel. Speed | Top Density | Gradient | Coating Weight (mg AgBr/dm$^2$) |
|---|---|---|---|---|---|
| Control | | | | | |
| 50 | .16 | 50 | 1.75 | 1.07 | 49 |
| 60 | .17 | 100 | 2.01 | 1.27 | 48 |
| 70 | .72 | 100 | 2.09 | 0.85 | 46 |
| 80 | 1.39 | 60 | 2.30 | 0.48 | 50 |
| Experimental | | | | | |
| 60 | .23 | 100 | 1.88 | 1.43 | 47 |
| 70 | .29 | 100 | 1.87 | 1.30 | 49 |
| 80 | .33 | 84 | 1.86 | 1.20 | 47 |
| 90 | .45 | 84 | 1.80 | 1.04 | 48 |

Besides showing better digestion latitude, the product shows equivalent speed with higher gradient.

EXAMPLE 7

A direct positive emulsion was made from silver iodobromide precipitated by splash procedures in the presence of Ag(I)Br seed crystals. Three emulsions were made. One, the control, had no seeds; number two had seeds of 0.0086$\mu^3$ present; and number three had seeds of 0.0378$\mu^3$. These emulsions were redispersed in gelatin, fogged with tetraazaundecane, and the usual wetting agents, antifoggants and coating aids added thereto. Each emulsion was coated on a support as previously described and strips from the coatings were exposed with an EG and G sensitometer to a tungsten flash for $10^{-2}$ seconds. These strips were then developed in DP-2 for 90 seconds followed by fixing, washing and drying. Sensitometric results show that speed equivalent to the control with higher gradients was obtained.

EXAMPLE 8

An emulsion was made following splash techniques. First, a seed emulsion was generated in situ using BDJ techniques. The process was as follows:

preparation of monodisperse AgIBrCl (ca. 0.5% I, 18.8% Br and 80.7% Cl). The first 50% of the volume is a monodisperse BDJ mix at 120° F., pAg 6.17 with:

a. 0–1.7%—single jet addition of 3N $AgNO_3$ to seed.
b. 1.7–37.5%—BDJ precipitation with 1.3% $I^-$, 52% $Br^-$, 46.7% $Cl^-$ and enough rhodium chloride for 0.2 $\mu$M/unit of silver nitrate as rhodium.
c. 37.5–50%—BDJ precipitation with 100% Cl.

At this point analysis by Particle Size Analyzer showed crystals with $V=0.0056\mu^3$ and $\sigma_g=1.40$.

Next, the temperature was reduced to 110° F. and KCl was added rapidly (1.4 X the amount of $AgNO_3$ remaining to be added). The temperature dropped to 100° F. and pAg was 9.96. After 1 minute, $AgNO_3$ (remaining 50% of volume) was added and the resulting emulsion stirred 5 minutes. The temperature was 108° F. after the $AgNO_3$ addition and dropped to 104° F. after 5 min. The pAg was 7.65.

This final emulsion was analyzed by Particle Size Analyzer and found to contain crystals with $V=0.0105\mu^3$ and $\sigma_g=1.55$.

EXAMPLE 9

A sample of BDJ prepared seeds (AgIBr, 2.5% $I^-$—with a crystal size of ca. 0.0378$\mu^3$) was placed in a mixing kettle and sufficient potassium iodide added to convert the entire sample to AgI. A splash-precipitation process (see Example 1) was then run on these seeds. Films made from this emulsion, after sensitization and coating as previously described, were processed with equivalent sensitometric results. The crystals were analyzed and found to be uniform in size and shape.

| | Fog | Rel. Speed | Gradient | Top Density |
|---|---|---|---|---|
| Experiment | .14 | 31 | 3.8 | 3.7 |
| Control | .15 | 100 | 3.5 | 3.8 |

EXAMPLE 10

A sample of BDJ prepared seeds (Ag 1.5% $I^-$98.5% $Br^-$, with a crystal size of 0.04$\mu^3$) was prepared. Solutions for splash preparation of AgIBr (2% $I^-$) were made up as follows:

| | |
|---|---|
| A. Solution ("Heel", made up in preparation vessel): | |
| Distilled water | 955 cc |
| $NH_4Br$ solid | 310 g |
| 0.5NKI | 120 cc |
| Gelatin | 40 g |
| Seeds | (0.2 moles/mole of $AgNO_3$). |
| Hold at 40.6° C. | |
| B. Solution (1st Silver): | |
| Distilled water | 1020 cc |
| Solution of Thallium Nitrate (8 g/liter) in water | 5.4 cc |
| 3N$AgNO_3$ | 320 cc |
| Hold at 29.8° C. | |
| C. Solution (2nd Silver): | |
| Distilled water | 373 cc |
| 3N$AgNO_3$ | 680 cc |
| Thallium Nitrate (see above) | 4.4 cc |
| Hold at 12° C. | |

Procedure:

5 min. before 1st silver, add seeds to A solution.
1 min. before 1st silver, add 191 cc of 12 M $NH_4OH$ to B solution.
At time = 0, add B to A in 30 seconds.
At time = 3 min. add C to A in 15 seconds.

-continued

| |
|---|
| At time = 9 min., stop ripening with 124 cc glacial acetic acid |
| Coagulation and wash procedures as described in Example 1. |

The emulsuion prepared in this manner was then redispersed in gelatin, sensitized with gold and sulfur, wetting agents, antifoggants, etc. added, and coated and overcoated as previously described. For control purposes, an element was made, sensitized, and coated under the same conditions but without the addition of the seed crystals of silver halide. Samples from the coatings were exposed, developed fixed, washed and dried as previously explained with the following sensitometry:

| Sample | Emul. Crystal Size ($\mu^3$) | Fog | Rel. Speed | Avg. Gradient | Top Density | $\sigma_g$ |
|---|---|---|---|---|---|---|
| Control | 0.23 | .22 | 100 | 2.86 | 2.09 | 2.3 |
| Of the Invention | 0.20 | .13 | 66 | 3.48 | 2.30 | 2.1 |

One can see that the film prepared from the emulsion made following the teachings of this invention had excellent gradient and top density, though somewhat lower speed than the control. The crystals, when examined under an electron microscope, were uniform in size and shape.

EXAMPLE 11

Following the procedures of Example 1 two additional splash-prepared emulsions were made varying the size of the seed crystals used. In one case, the BDJ prepared seeds were AgIBr seeds of about 0.6$\mu^3$ (ca. 2.5% $I^-$) and in the second case were AgIBr seeds of about 0.039$\mu^3$ (ca 2.5% $I^-$). The emulsions were analyzed by particle size analyzer and by electron micrograph and found to contain uniform particle sizes, indicating that one can use fairly large seed crystals within the ambit of this invention.

| Seed Vol. ($\mu^3$) | Final Crystal Vol. ($\mu^3$) | $\sigma_g$ |
|---|---|---|
| 0.039 | 0.24 | 1.48 |
| 0.06 | 0.44 | 1.27 |

EXAMPLES 12 AND 13

In a like manner, additional splash-prepared emulsions were made using BDJ-prepared seeds of AgIBr (ca. 2.5% $I^-$) and additionally containing small amounts of rhodium (EX. 12) or lead (EX. 13). The process of preparing these seed crystals is well known and is fully described in U.S. Pat. No. 4,221,863 (Overman, Sheeto). These splash-prepared emulsions were redispersed and then fogged to obtain excellent quality direct positive elements with good uniformity of crystal.

EXAMPLE 14

Two mixes: control, normal splash mix; Experimental (seeded), made as in Example 4, Sample 1, except that $\frac{1}{2}I^-$ added to "A" solution, $\frac{1}{2}I^-$ added over 7 min. beginning with addition of 1st silver solution.

| | | |
|---|---|---|
| Sensitization: | 1.37 mg/Ag mole $AuCl_3$ | for both |
| | 0.11 g/Ag mole NaSCN | |
| for control: | 1.66 mg $Na_2S_2O_3.5H_2O$/Ag mole | |
| for experimental: | 2.66 mg $Na_2S_2O_3.5H_2O$/Ag mole | |
| Control digested: | 50 min | |
| Experimental: | 70 min | |

Results, after exposure and development as in Ex. 6:

| Vol. ($\mu^3$) | $\sigma_g$ | Fog | Speed | Gradient | Top Density |
|---|---|---|---|---|---|
| Control | | | | | |
| 0.27 | 2.00 | 0.24 | 100 | 1.02 | 1.86 |
| Experimental | | | | | |
| 0.32 | 1.76 | 0.17 | 104 | 1.21 | 1.89 |

This result shows higher gradient and slightly higher speed for the emulsion made according to the teachings of this invention compared to that of the control emulsion.

EXAMPLE 15

In order to compare emulsions made by all three procedures (single jet, BDJ and splash) and to see the effects of the process of this invention on the final crystal size distribution, three emulsions are made as follows:

A. Single jet addition of silver nitrate to a gelatino halide salt solution containing silver halide seeds made by a double jet procedure (see Brit. Pat. No. 1,350,619, Example 1).

B. Balanced double jet addition of both silver nitrate and alkali halide to a gelatino solution containing seed crystals made by a BDJ procedure (see Corben et al. U.S. Pat. No. 4,339,532, Example 5).

C. Splash addition of silver nitrate to a gelatino halide salt solution containing silver halide seeds made by a BDJ procedure (see Example 2, Sample 3 of this invention).

In each case, the predicted mean volume of the resulting silver halide crystals is compared to actual crystal volume found with the results shown below:

| Mean Crystal[1] Vol. ($\mu^3$) of the Final Emulsion | Emulsion Manufacturing Process (A) Single Jet | (B) BDJ | (C) Splash of this Invention |
|---|---|---|---|
| Predicted Value | 0.003 | 1.830 | 0.410 |
| Actual Value | 0.180 | 0.840 | 0.450 |

[1]The predicted value is determined mathematically assuming that each final crystal of silver halide will result from growth of new silver halide material on the seed crystal, e.g., $$V = \left(\frac{m}{N}\right)\left(\frac{M.W.}{P}\right)(10^{12})$$

wherein

V = the volume of the final crystal ($\mu^3$)
M = the number of moles of silver halide
N = the number of seed crystals in the emulsion
M.W. = molecular weight of the material used
P = density of the material used (g/cm$^3$)

As can be seen, the process of this invention will produce crystals with a mean crystal volume very close to the predicted value while the processes of the prior art do not.

We claim:

1. In a process for preparing silver halide emulsions with a narrow particle size distribution and highly disordered crystals, wherein silver nitrate solution is added to a solution of halide salt dispersed in a protective colloid in a series of rapid additions, at least one of said additions containing ammonia, the improvement comprising adding monodisperse silver halide seed crystals prepared by a BDJ process to said halide salt solution prior to the addition of said silver nitrate solution.

2. A process according to claim 1 wherein the silver nitrate is added in a series of 2 to 6 rapid additions.

3. A process according to claim 1 wherein the silver nitrate is added in a series of 2 to 3 rapid additions.

4. A process according to claim 2 wherein each rapid addition ranges from 0.25 to 2 minutes.

5. A process according to claim 2 wherein each rapid addition ranges from 20 seconds to 40 seconds.

6. A process according to claim 2 wherein after each rapid addition of silver nitrate the reaction mixture is maintained for a period of 2 to 15 minutes.

7. A process according to claim 2 wherein after each rapid addition of silver nitrate the reaction mixture is maintained for a period of 3 to 7 minutes.

8. A process according to claim 1 wherein the silver halide emulsion is an iodobromide emulsion.

* * * * *